United States Patent [19]

Bull

[11] 4,136,810

[45] Jan. 30, 1979

[54] AUTOMATIC NAILER GUN AND MAGAZINE

[75] Inventor: William T. Bull, Oxnard, Calif.

[73] Assignee: Advance Nailing Tools, Inc., Santa Paula, Calif.

[21] Appl. No.: 845,820

[22] Filed: Oct. 27, 1977

[51] Int. Cl.[2] ..... B25C 1/04

[52] U.S. Cl. ..... 227/120

[58] Field of Search ..... 227/120, 136

[56] References Cited

U.S. PATENT DOCUMENTS

| | | | |
|---|---|---|---|
| 3,491,932 | 1/1970 | Novak | 227/136 |
| 3,820,705 | 6/1974 | Beals | 227/120 X |

*Primary Examiner*—Roy Lake
*Assistant Examiner*—Paul A. Bell
*Attorney, Agent, or Firm*—Christie, Parker & Hale

[57] ABSTRACT

A magazine of a nailer gun organizes nails with the head of each nail in sliding contact with parallel support rails and the point of each nail on a support track that parallels the rails. The rails and track orient the nails so that they are parallel to each other and at an acute angle to the perpendicular between the rails and track. In this orientation the head of each nail overlaps the head of the nail preceding it and contacts the shaft of the nail following it. At a driver head of the gun, the distance between the point support track and the rails lengthens and the nails rotate for alignment with the axis of a chamber of the driver head. Upon reaching the chamber, each nail drops a short distance onto a dog and is retained in place by the dog. A driver of the gun impacts the nail in the chamber and drives it. The dog swings out of the way in response to the impact of the driver. A nail guide rotates and slides away from the chamber upon being engaged by a bent nail. Nails in a clip feed into the magazine through a gravity feed orientation passage that receives the nails from the clip one at a time and separates the received nail from the others so that the nail heads separate before introduction to the constraints of the rails and the point support track of the magazine.

27 Claims, 8 Drawing Figures

AUTOMATIC NAILER GUN AND MAGAZINE

BACKGROUND OF THE INVENTION

The present invention relates in general to the art of nailing and, more in particular, to the art of automatic nailing tools.

Nails for years have been driven by hand-held hammers. In comparatively recent times nailing guns have become available. Typically, the guns are pneumatically powered, extracting energy from compressed air to drive a nail at the command of a gun's operator. The guns have a body housing the passages, valving and pistons used in converting pneumatic energy into the kinetic energy of the driver. A driver head of the gun has a chamber that receives individual nails and orients nails into the path of the driver. A magazine feeds nails to the chamber.

The nails for automatic nailing guns have come prepackaged. Typically, the nails are oriented with their axis in a plane, their heads overlapping, their shafts parallel, their heads at the same elevation, and their shafts held together by parallel plastic bands. A spring loaded follower urges the banded nails towards the chamber of the gun. With the driving of each nail, a new nail advances into the chamber for subsequent driving.

Prepackaged nails are considerably more expensive than loose nails. A second disadvantage is the bands that orient the nails. When the nails are discharged from the gun, the plastic strips are cut into small pieces and discharge with the nails. These pieces can make a work area very slippery, which can be very serious in such places as roofs. Further, it takes time to clean up the strips to prevent the hazzard and to present a well kept appearance.

A difficulty with a spring-biased follower is the tendency of the follower to buckle the nails that it urges against. Accordingly, the number of nails in a package of nails with the orienting straps must be limited.

SUMMARY OF THE INVENTION

The present invention provides a nailing gun and magazine that take loose, uncoordinated nails and orient them for feed through the magazine into a chamber of the nailer. It also provides a simple way of holding a nail in the chamber independently of following nails.

In one form the present invention contemplates a nailer gun having a driver for driving individual nails from a magazine. The magazine couples to a driver head of the gun so that nails in the magazine feed into a chamber of the driver head by gravity. The magazine has means against which the heads of the nails bear. The magazine also has means for supporting the points of the nails, preferably a point track. The shortest distance between the head support and point support of the magazine is noticeably smaller than the distance between the head and the point of the nails served by the magazine. This aligns the nails in the magazine by gravity in echelon fashion, with the head of a trailing nail overlapping the head of a preceding nail, and the head of a preceding nail contacting the shaft of a trailing nail, and with the shafts of the nails parallel. This arrangement presents to the chamber one nail at a time and maximizes the capacity of the magazine for nails.

Preferably, at the exit end of the magazine, the distance between the point support means and the head support means increases so that the axes of the nails rotate by gravity into parallelism with the axis of the chamber. A dog in the chamber acts on the nails below the exit point of the nails from the magazine into the chamber so that the head of a nail in the chamber is below the head of the nail following it by a stepped amount. The head of the nail in the chamber bears on the shaft of the nail following it to keep the nail in place and out of the chamber. As the nail in the chamber is driven from the chamber, its head keeps the following nail out of the chamber until the driver is sufficiently within the chamber to form this exclusion function. Preferably, a cover of the magazine over the heads keeps the nails in their preset echelon formation by preventing the nails from bouncing up and reversing their angular orientation. It is also preferred that the point support means proximate the chamber be provided by a nail guide pivotable with respect to the magazine for ejecting bent and damaged nails under the impetus of the driver.

In preferred form the nail guide pivots to the magazine and is spring-biased into a closed position. An upper surface of the nail guide provides the nail point support means in the form of a track proximate the chamber. As the chamber approaches, the distance between the track provided by the nail guide and the nail head support increases so that the nails rotate by gravity to a more or less vertical orientation. The angle of the track provided by the nail guide is severe enough so that a space opens up between the nails proximate their points to permit some movement of a nail next in line to the chamber back up the magazine in response to the passage of the nail head of the nail being fired without moving other nails up the magazine. So as to develop an exit for damaged nails rapidly, the nail guide not only pivots but moves in translation away from the chamber in response to a force applied to it in that direction by a nail. This facility can be accomplished by slotting the nail guide at the pivot so that the guide moves across the pivot as well as rotating about it.

Preferably, the magazine cross section is U-shaped, the tops of the parallel legs of the U forming rails that provide the head support means for the nail heads and the base or bight of the U providing the point support means in the form of a track. The constraining bumper or cover preferably is open on one side so that the number of nails in the magazine can be checked quickly to give access to the nails in case of a jam.

The mouth of the magazine has means to orient the nails in the echelon formation described. Preferably these means include a vertical passage leading into the magazine through which only one nail at a time can fall. The free fall provided by the vertical passage separates the nails in a clip so that they orient into the echelon with the head of each following nail overlapping the head of its immediately preceding nail and bearing against the shaft of the immediate following nail.

These and other aspects and advantages of the present invention will become more apparent from the following description, appended claims and drawings.

DESCRIPTION OF THE PREFERRED EMBODIMENT

Figure 1:
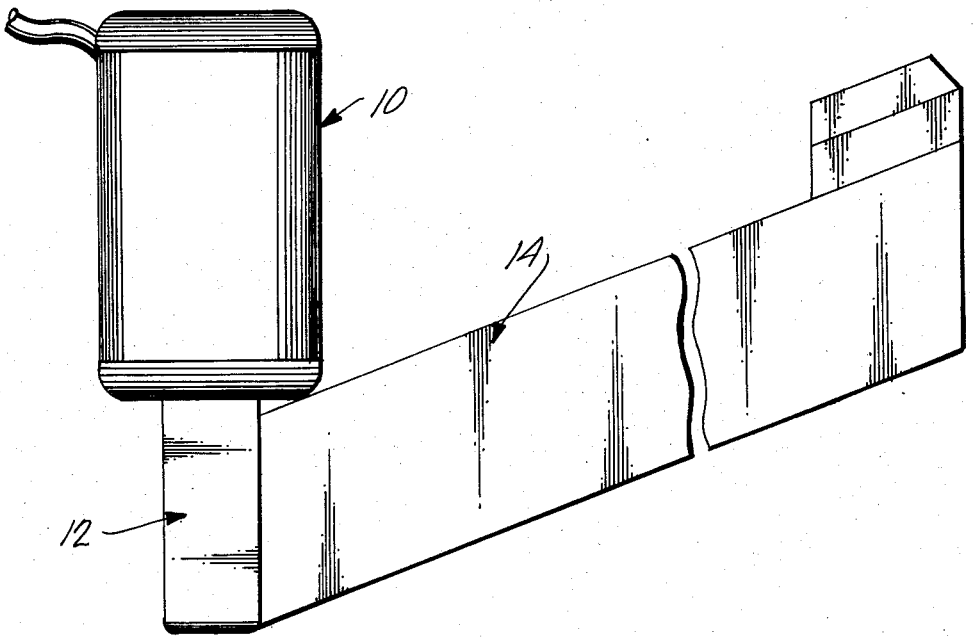
FIG. 1 illustrates in simplified form a nailer and magazine constructed in accordance with the present invention.

FIG. 1 shows the organization of the present invention in very general terms. There, a pneumatic gun 10 of standard configuration, except for a driver head 12 of the gun, receives nails one at a time from a magazine 14. The energy of the compressed air drives a piston in the gun which in turn drives a driver that impacts a nail in the chamber of the driver head and drives the nail into the work. Magazine 14 feeds nails to driver head 12 by gravity.

Figure 2:
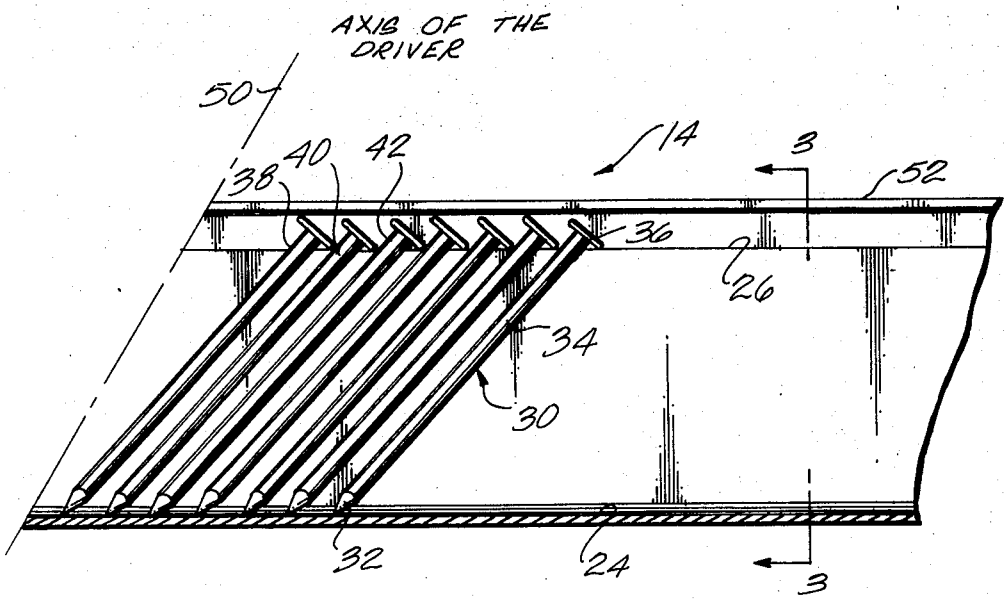
FIG. 2 is a partial view in elevational cross section of the magazine of the present invention.

FIG. 2 illustrates in better detail the construction of magazine 14. The magazine has a deep and narrow U-shaped channel or chute 16. The channel has two parallel and vertical walls 18 and 20. It has a bottom wall or bight 22 integral with and connecting the vertical walls. The inside surface of bottom wall or bight 22 forms a point support track 24. The upper edges of walls 18 and 20 act as rails 26 and 28. These rails support the heads of the nails in the magazine. Rails 26 and 28 parallel track 24 and the perpendicular distance between the rails and the track is shorter than the length of a nail used with the magazine.

Figure 3:
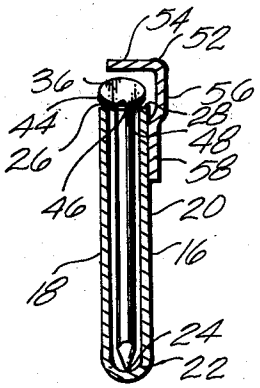
FIG. 3 is a view of the magazine of FIG. 2 taken along line 3—3 of FIG. 2.

As seen in FIG. 2, the chute defined by the U-shaped channel receives nails 30. For purposes of nomenclature, each nail has a point 32, shaft 34, and a head 36. The nails orient in the magazine with their shafts parallel to each other, their axes in a common plane, and in an echelon formation. This formation can readily be seen from three of the nails, 38, 40 and 42. Nail 38 precedes nail 40 and nail 40 precedes nail 42, all of the nails being aligned serially one after the other. The head of nail 40 overlaps the head of nail 38. The head of nail 40 lies under the head of nail 42. Thus, the heads of the nails overlap the heads of the immediately preceding nails and lie under immediately trailing nails. The nails are supported at three points. Rails 26 and 28 support the rim of each of the nail heads. Thus in FIG. 3, nail head 36 has a rim 44 that rests on the interior corners of rails 26 and 28, respectively, at 46 and 48. Point 32 of the nail is supported by track 24. The shortest distance between rail 26 and track 24, the perpendicular distance, is shorter than the length of the nails so that the nails lie over on their side in echelon formation described previously. Finally, the nails are proximated to each other such that the head of each preceding nail contacts the shaft of the following nail. With reference again to nails 38, 40 and 42, the head of nail 38 rests against the shaft of the following nail 40, and the head of nail 40 rests against the shaft of the nail following it, nail 42.

The magazine is pitched to develop an angle to the horizontal, say about 30°, and a stable lie and positive gravity feed for nails in the magazine.

As can be seen in FIG. 2, an axis of the driver, indicated at 50, does not parallel the axis of the nails. The axis of the driver, in use, will usually be about vertical. As will become apparent, this angular offset between the nails in the magazine and the axis of the driver allows the nails to repose in a highly stable orientation, with the weight of each nail tending to maintain the nail on its three-point seat of the tops of the rails and the track. If the nails are more vertical, jars and the like tend to more easily unseat the nails and possibly cause a jam.

To retain the nails in the magazine, a cover 52 lies over the chute of the magazine. The cover has a lip or bumper 54 lying immediately over the chute and in position to be contacted by the heads of the nails. A vertical offset section 56 of the bumper is spaced away from the chute to provide ample clearance of the nail head laterally of the cover. A vertical inset section 58 of the bumper connects to the offset section and attaches to wall 20 of the U-shaped channel. Bumper 54 and vertical sections 56 and 58 are integral with one another. The cover is open on one side so that the nails are clearly visible and for access to the nails in the magazine to clear any jam.

Figure 5:
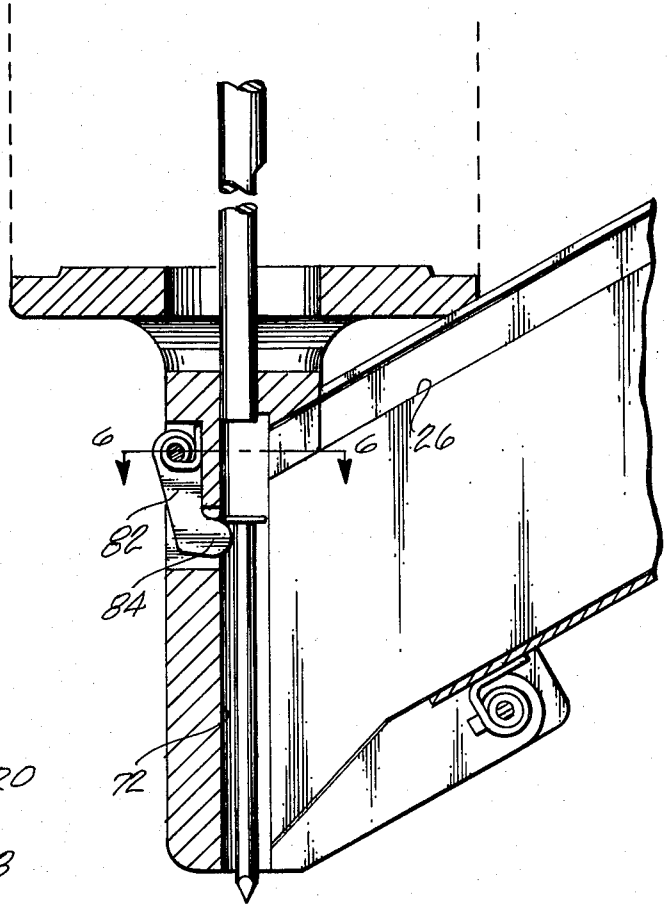
FIG. 5 is a view similar to FIG. 4 illustrating the cooperation of the magazine and the driver head in keeping and orienting the last nail of the magazine.
Figure 4:
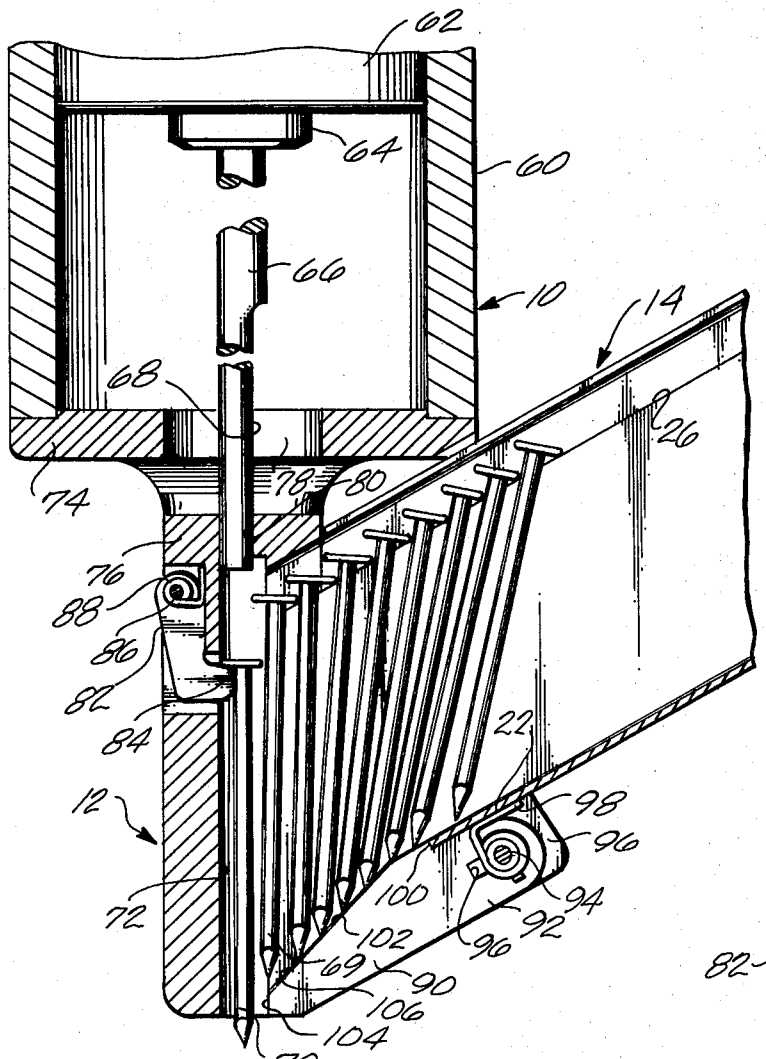
FIG. 4 is a partial view in cross-sectional elevation of the driver gun, driver head, and magazine of the present invention.

FIGS. 4 and 5 show the relationship between magazine 14, driver head 12, and gun 10.

Beginning with the gun, as previously mentioned, the gun itself, except for the head, is standard. Accordingly, it is not completely shown, and what is shown has been simplified to a point consistent with a clear understanding of the relationship of the gun with the other elements of the invention. The gun has a barrel 60 that receives a piston 62. Piston 62 responds to pneumatic energy admitted into the gun in response to an operator's periodic command and translates rapidly down the inside of the barrel. Piston 62 attaches as by threads to a driver head 64. A driver's proper 66 attaches to the head and passes coaxially of the piston into driver head 12. Driver 66 is relieved at 68 to clear the head of a nail 69 next in line for firing after a nail 70 in chamber 72 of head 12 has been driven by the driver.

Driver head 12 has a base plate 74 that attaches to barrel 60 of the gun as by fasteners. A nose 76 extends from base 74 coaxially of driver 66. An air relief port 78 from within the gun to atmosphere passes through base 74 and laterally outside of nose 76. Nose 76 defines chamber 72 for the nails.

Figure 6:
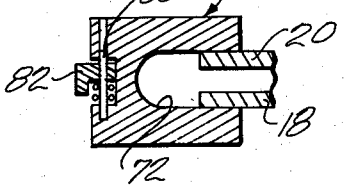
FIG. 6 illustrates the magazine in cross section as taken along line 6—6 of FIG. 5.

Chamber 72 is circular and of a diameter just slightly exceeding the diameter of the head of the nails to be driven. The chamber is essentially closed on all lateral sides except the side facing the exit of the magazine. There, as can be seen in FIG. 6, the chamber opens into the magazine and has a width corresponding to the width of the chute of the magazine, the distance between walls 18 and 20.

Driver 66 extends through a passage 80 into chamber 72 for impacting the head of a nail there.

A dog 82 has a nose 84 normally within the chamber to support and locate a nail there. The dog is pivotally connected by a pivot pin 86 to the nose and is spring biased by spring 88 into position as shown in FIG. 4 with nose 84 supporting a nail in the chamber. Nose 84 of the dog is spaced below an imaginary continuation of rail 26 to permit nails coming into the chamber to drop vertically a short distance before being arrested by the dog. This permits the head of the nail in the chamber to bear on the nail immediately following it at a point on the following nail's shaft more intermediate the ends of the nail than is the case of the nails in the magazine. This increases the restraining moment on the following nail to keep its point from entering the chamber and jamming the nail already in the chamber. The dropping of the nail a short distance from the imaginary continuation of the line of the support rail also assures that the point of the nail clears the end of a nail guide 90. Dog 82 has its equivalent in a ball or plunger-type detent.

When driver 66 impacts a nail in the chamber, the closing force of spring 88 is overcome and the dog swings out and away from the head of the nail.

The upper surface of nail guide 90 is dimensioned to increase the distance between the upper and lower supports of the nails to bring the axes of the nail into closer parallelism with the axis of the chamber. The nail guide also permits the clearing of the chamber of a bent nail. More specifically, nail guide 90 consists of a finger 92 pivotally connected through a pivot pin 94 to magazine 14 at a nail guide bracket 96 attached to the magazine. A spring 98 between the magazine and the nail guide biases the nail guide in a clockwise direction. A stop for the nail guide is provided by bottom wall 22 of the magazine. A slot 96 permits the nail guide to move in translation in response to a force acting along the long axis of the nail guide and away from chamber 72. When a bent nail must be ejected from the chamber, driver 66 impacts the nail and the nail will engage the nail guide. This engagement will produce a force on the nail guide which will rotate it counterclockwise to open the nail guide. The force may also be sufficient to translate the nail guide after sufficient rotation has taken place for a shoulder 100 of the nail guide to clear the end of wall 22.

An upper inclined surface 102 of the nail guide progressively develops a greater space between support rail 26 and the surface so that the nails become increasingly aligned with the axis of the chamber. The upper wall of the nail guide still supports the points of the nails. A leading edge 104 of the nail guide borders chamber 72. The end of surface 102 immediately adjacent to chamber 72 is spaced from rails 26 and 28 a distance greater than the shaft and point length of a nail so that a nail poised just outside of the chamber does not have its point supported by the nail guide. As previously mentioned, this nail, say a nail 69, is supported by the head of a nail in the chamber and rails 26 and 28. The failure to support the point of nail 69 permits the nail being fired, say nail 70, through its head to force the shaft of nail 69 slightly back up the magazine. But a sufficient space exists between nail 69 and the nail immediately trailing it so that all the nails in the magazine are not forced up the magazine during the firing of a nail. Therefore, the nails in the magazine do not interfere with nails being fired out of the chamber.

FIG. 5 shows how the last nail of a load of nails supports in the chamber. The nails has slid off of rails 26 and 28 and onto nose 84 of dog 82. The circular walls of chamber 72 and the ends of walls 18 and 20 provide lateral bearing on the head of the nail in the chamber, as can be seen in FIG. 6.

In FIG. 6, walls 18 of magazine 14 extend into mating slot of driver head 12. The vertical ends of walls 20 and 18 provide the constraint of the nail head in chamber 72 against lateral displacement once the nail has dropped off of rails 26 and 28 into the chamber.

Magazine 14 attaches to driver head 12 as by a force fit between walls 18 and 20 and cooperating walls of the driver head. One or more fasteners are used to secure this relationship.

Figure 8:
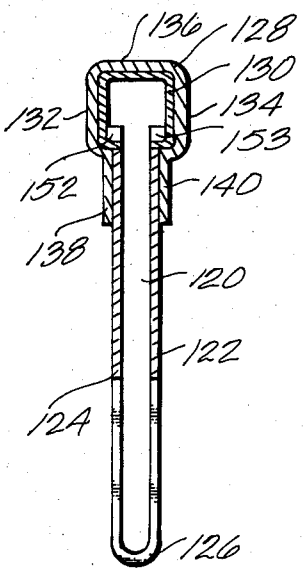
FIG. 8 shows the cooperation between the loading clip and magazine of FIG. 6 taken along line 7—7 of FIG. 6.
Figure 7:
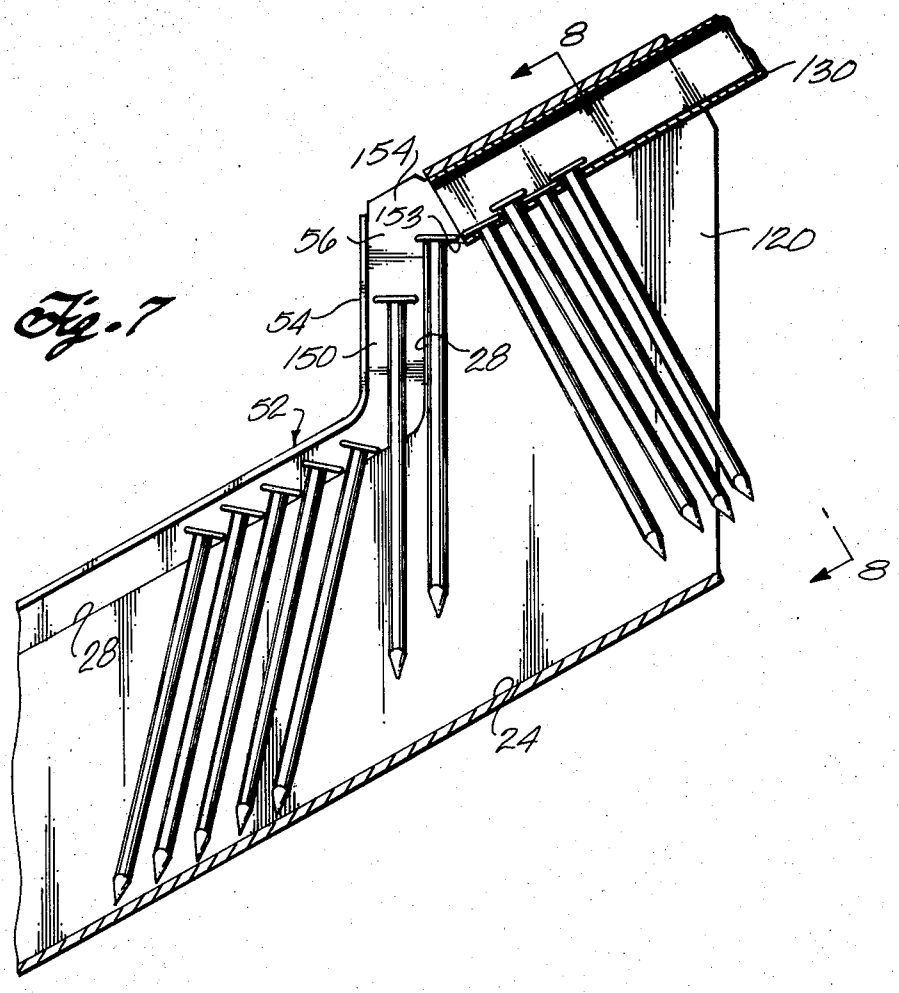
FIG. 7 illustrates in elevational cross section the mouth end or entrance to the magazine and a loading clip.

FIGS. 7 and 8 show the entrance end of magazine 14. The magazine has a mouth 120 defined by two vertical walls 122 and 124. These walls are connected together by a bottom wall 126 which forms the bight of a U-shaped in end view entrance. The height of walls 122 and 124 exceeds the height of the nails that are being held in the magazine. A receiver 128 at the upper end of walls 122 and 124 has a generally square passage that receives a nail clip 130. The nail clip is also square in cross section and has a perimeter sized to be received in the passage within receiver 128. The bottom of the nail clip is open so that the shafts of the nails can extend from the clip and hang loosely, as can be seen in FIG. 7. Receiver 128 has vertical walls 132 and 134 connected together at their tops by a horizontal wall 136. The receiver necks in somewhat from walls 132 and 134 to vertical, inset walls 138 and 140. These walls lie against and attach to walls 124 and 122, respectively. Entrance 120, then, is a deep chute for receipt of shafts of nails and a large passage capping the chute for receipt of the heads of the nails and the box in section nail clip.

As can be seen in FIG. 7, the nails in the clip array with the head of every other nail overlying the nail preceding it and the nail following it, that is, alternate nail heads overlie the heads of their immediate neighbors. This nail orientation is not satisfactory to the magazine. In the magazine the nails must be oriented in the echelon formation described. The entrance into the magazine separates the nails from the clip so that they fall into the echelon formation. Rails 26 and 28 extend into the enlarged mouth of the magazine to bottom a vertical passage 150. This passage is sized to pass one nail only at a time. That is, the diameter of the passage will not permit the passage of two nails at the same time. Just up from passage 150 a pair of generally horizontal steps or rails 152 and 153 support the heads of nails at the threshold to passage 150. The head of a nail descending through passage 150 keeps its following nail on the threshold. The gravitational force of nails following the threshold nail tends to force that nail into passage 150. The resisting force of friction on the threshold nail head and of the head of the nail descending through the passage overcomes the gravitational force of the nails in the clip that would push the nail over the brink and into the passage. As soon as the nail descending the passage passes from the passage, the nail at the threshold no longer is restrained and is forced into the passage by the nails behind it.

The entrance end of the magazine is open at 154 right above passage 150. Cover 52 defines two sides of passage 150. Rails 26 and 28 extend upwardly at the entrance side of passage 150 to define the side of the passage on that side. As will be recalled, the distance between the rails admits to the passage of the shafts of the nails but not the heads. One side of passage 150 is open, the side opposite wall 56.

The entrance to the magazine has vertical side walls that assure that the nail shafts in the clip have their axes falling in a common plane. Thus the nails in the clip, when they reach the inside of the entrance to the magazine, have gone through one phase of orientation just to get there.

In operation, a clip 130 filled with nails is plugged into receiver 128. The shafts of the nails in the clip are brought into parallel relation with the major plane of the entrance of magazine 14. The nails of the clip will then enter the magazine. The leading nail will fall in passage 150 until its point contacts track 24. It will then rotate slightly until its head is supported by rails 26 and 28. The following nail will hang up on the threshold defined by steps 152 and 153 until the leading nail is clear of passage 150. The nails after passage 150 rack to form the echelon formation described. When the magazine is filled, the clip is removed.

The first nail in the magazine will pass completely through the magazine and fall off rails 26 and 28 into chamber 72, as seen in FIG. 4. This nail prevents the nail immediately following it from entering the chamber by the bearing of the head of the nail in the chamber on the shaft of the following nail. Dog 82 is oriented with its nose 84 underlying the head of the nail. The shaft of the nail extends slightly past the end of the chamber and clear of face 104 of the nail guide. A nail in chamber 72 restrains a nail at the threshold to the chamber. The fall-off of the nail point support track on the nail guide, which begins a few nail diameters away from the chamber and continues to the chamber, assures that at the threshold a nail point will be spaced from the track and the next following nail. Accordingly, the nails following the threshold nail will not interfere with a slight displacement of that nail up the magazine by a nail being fired from the chamber. Upon firing the gun, driver 66 impacts the head of the nail and dog 82 rotates out of the way and the nail is set.

In the event that a nail is damaged in chamber 72, it will apply a force to nail guide 90 which will rotate the nail guide counterclockwise and force the guide to translate slightly away from the chamber, opening the exit from the chamber so that the nail can be kicked free of the gun. As a nail leaves the chamber it applies a slight force on the shaft of the following nail and forces that shaft in a direction up the magazine. However, a space developed between the points of the nails and the fact that the following nail hangs freely on the verge of entering chamber 72 allows a slight motion without backing up all, or several of the nails in the magazine.

The present invention provides a nail gun of eloquently simple construction. Feed is by gravity and there is no requirement for nails to be held together by plastic strips with the attendant disadvantages of expense, safety hazzard, and clutter.

The present invention has been described with reference to a preferred embodiment. The spirit and scope of the appended claims should not, however, necessarily be limited to the foregoing description.

What is claimed is:

1. An improved automatic, hand-held nailer comprising:

(a) a gun selectively operable by an operator and having driver means for impacting the head of a nail with sufficient force to set the nail;

(b) a driver head having a chamber for receipt of a nail of a predetermined size and passage of the driver means into the chamber to impact the head of a nail there;

(c) means to hold the nail in the chamber and for releasing the nail when the driver means impacts the nail; and (d) magazine means for storing a plurality of nails and to sequentially feed the nails into the chamber, the magazine means including:

(i) nail head support means to support the head of a nail, (ii) nail point support means to support the points of the nails, and (iii) the nail head and point support means being oriented at an angle to the horizontal and having a distance between them shorter than the distance between the nail head and the point of the nails to be used in the magazine so that the nails orient in echelon fashion, with each nail head overlapping the head of the nail immediately preceding it and engaging the shaft of the nail immediately following it.

2. The improved nailer claimed in claim 1 wherein the nail head support means terminate at the chamber and the means to hold the nail in the chamber does so after the nail has dropped a short distance from the head support means and the head of a nail in the chamber bears on and restrains the shaft of a nail immediately following it at the threshold to the chamber.

3. The nailer claimed in claim 2 wherein the nail point support means proximate the chamber drops progressively away from the nail head support means from a point a few nail diameters from the chamber to the chamber, such that the distance at the threshold to the chamber in the magazine between the nail point support means and the nail head support means is greater than the distance between the nail head and the nail point, the head of a nail in the chamber restrains the shaft of a nail at the threshold, and the point of a nail at the threshold is spaced from the point of a nail following it, whereby a nail supported at the threshold to the chamber on the nail head support means has its point free of the point support means and a nail being driven from the chamber can act laterally on the nail at the threshold to the chamber and displace the shaft of such nail slightly away from the chamber and up the magazine without resistance from nails following the threshold nail.

4. The nailer claimed in claim 2 wherein the nail head support means comprises two parallel rails having a distance between them greater than the diameter of the shaft of the nail but less than the diameter of the head of the nail.

5. The nailer claimed in claim 4 wherein the nail point support means includes a nail point track paralleling the two parallel rails for at least a substantial length of the magazine.

6. The nailer claimed in claim 5 wherein the nail point support means proximate the chamber drops progressively away from the nail head support means from a point a few nail diameters from the chamber to the chamber, such that the distance at the threshold to the chamber in the magazine between the nail point support means and the nail head support means is greater than the distance between the nail head and the nail point, the head of a nail in the chamber restrains the shaft of a nail at the threshold, and the point of a nail at the threshold is spaced from the point of a nail following it, whereby a nail supported at the threshold to the chamber on the nail head support means has its point free of the point support means and a nail being driven from the chamber can act laterally on the nail at the threshold to the chamber and displace the shaft of such nail slightly away from the chamber and up the magazine without resistance from nails following the threshold nail.

7. The improvement claimed in claim 2 wherein means to hold a nail in the chamber includes detent means in the path of the head of a nail in the chamber and retractable from such path upon the application of an impact force of the driver on the nail head.

8. The improvement claimed in claim 7 wherein the nail head support means comprises two parallel rails having a distance between them greater than the diameter of the shaft of the nail but less than the diameter of the head of the nail and the nail point support means includes a nail point track paralleling the two parallel rails at least for a substantial length of the magazine.

9. The nailer claimed in claim 1 including a nail guide and release, the nail guide and release defining at an upper surface the nail point support track proximate the chamber, the nail guide and release being pivoted to the nailer to swing away from the chamber and develop a large exit therefrom upon the application of a force corresponding to the force of a driver acting on a damaged nail in the chamber.

10. The nailer claimed in claim 9 wherein the nail guide and release includes means to permit the nail guide and release to slide translationally as well as to rotate about the pivot in response to the force of the driver acting on a damaged nail in the chamber.

11. The nailer claimed in claim 10 wherein the nail head support means terminate at the chamber and the means to hold the nail in the chamber does so after the nail has dropped a short distance from the head support means and the head of a nail in the chamber bears on and restrains the shaft of a nail immediately following it at the threshold to the chamber.

12. The nailer claimed in claim 11 wherein the nail guide and release has a surface defining a portion of the nail point support means and such surface drops progressively away from the nail head support means from a point a few nail diameters from the chamber to the chamber, such that the distance at the threshold to the chamber in the magazine between the nail point support means and the nail head support means is greater than the distance between the nail head and the nail point, the head of a nail in the chamber restrains the shaft of a nail at the threshold, and the point of a nail at the threshold is spaced from the point of a nail following it, whereby a nail supported at the threshold to the chamber on the nail head support means has its point free of the point support means and a nail being driven from the chamber can act laterally on the nail at the threshold to the chamber and displace the shaft of such nail slightly away from the chamber and up the magazine without resistance from nails following the threshold nail.

13. The nailer claimed in claim 12 wherein the nail head support means comprises two parallel rails having a distance between them greater than the diameter of the shaft of the nail but less than the diameter of the head of the nail and the nail point support means include a nail point track paralleling the two parallel rails at least for a substantial length of the magazine.

14. The nailer claimed in claim 13 wherein means to hold a nail in the chamber includes detent means in the path of the head of a nail in the chamber and retractable from such path upon the application of an impact force of the driver on the nail head.

15. An improved automatic, hand-held nailer comprising:

(a) a gun selectively operable by an operator and having a driver for impacting the head of a nail with sufficient force to set the nail;

(b) a driver head having a chamber for receipt of a nail of a predetermined size and passage of the driver into the chamber to impact the head of a nail there;

(c) means to hold the nail in the chamber and for releasing the nail when the driver impacts the nail; and (d) magazine means for storing a plurality of nails of predetermined size and type and to sequentially feed the nails into the chamber, the magazine means including:

(i) a pair of nail head support rails to support each of the heads of the nails stored in the magazine, the rails being parallel and spaced apart by a distance less than the diameter of each of the heads of the nails and greater than the shaft diameter of each of the nails, (ii) a nail point support track to support the points of the nails, the track being parallel to the rails for substantially the entire length of the track, (iii) the rails and point support track being oriented at an angle to the horizontal and having a perpendicular distance between them shorter than the distance between the nail head and the point of the nails so that the nails orient in echelon fashion, with each nail head overlapping the head of the nail immediately preceding it and engaging the shaft of the nail immediately following it.

16. The improved automatic nailer claimed in claim 15 including a cover of the magazine over the rails and in position to keep the nails in the magazine and in the echelon formation despite jarring forces.

17. The improved automatic nailer claimed in claim 16 wherein the magazine includes a deep chute of two upright, spaced apart and parallel side walls connected at their base by a bottom wall, the bottom wall forming the track and the tops of the side walls defining the rails, the shafts of the nails being received in the chute.

18. The improved automatic nailer claimed in claim 17 wherein the means to hold the nail in the chamber includes means to support a nail in the chamber by the head of the nail at a location vertically stepped down from the rails so that the nail head in the chamber has an elevational difference with respect to the head of a nail in the magazine next in line to be received in the chamber that is greater than elevational differences between the heads of adjacent nails in the magazine, and the magazine is sufficiently close to the chamber that the head of a nail in the chamber will engage and restrain the shaft of the nail next in line to be received in the chamber.

19. The improved automatic nailer claimed in claim 15 wherein the magazine has a mouth for receiving nails, the mouth having means for separating received nails and establishing the echelon orientation.

20. The improved automatic nailer claimed in claim 19 wherein the separating means of the mouth includes a vertical passage capable of passing only one of the nails at a time onto the rails.

21. The improved automatic nailer claimed in claim 20 including horizontal step means at the entrance to the vertical passage to support a nail by engaging the head of the nail until the vertical passage is clear of any preceding nail.

22. The improved automatic nailer claimed in claim 21 including receiver means of the mouth for receiving a clip of nails on the side of the step means opposite the vertical passage.

23. The improved automatic nailer claimed in claim 22 wherein the means to hold the nail in the chamber includes means to support a nail in the chamber by the head of the nail at a location vertically stepped down from the rails so that the nail head in the chamber has an elevational difference with respect to the head of a nail in the magazine next in line to be received in the chamber that is greater than elevational differences between the heads of adjacent nails in the magazine, and the magazine is sufficiently close to the chamber that the head of a nail in the chamber will engage and restrain the shaft of the nail next in line to be received in the chamber.

24. The improved automatic nailer claimed in claim 23 wherein the magazine includes a deep chute of two upright, spaced-apart and parallel side walls connected at their base by a bottom wall, the bottom wall forming the track and the tops of the side walls defining the rails, the shafts of the nails being received in the chute.

25. The improved nailer claimed in claim 24 wherein the nail point support track proximate the chamber drops progressively away from the rails from a point a few nail diameters from the chamber to the chamber, such that the point of a nail in the magazine next in line to the chamber is unsupported, the head of a nail in the chamber restrains the shaft of a nail next in line to the chamber, and the point of a nail next in line to the chamber is spaced from the point of a nail following it, whereby a nail being driven from the chamber can act laterally on the nail next in line to the chamber and displace the shaft of such nail slightly away from the chamber and up the magazine without resistance from following nails in the magazine.

26. The improved nailer claimed in claim 25 including a nail guide and release, the nail guide and release defining at an upper surface the nail point support track proximate the chamber, the nail guide and release being pivoted to the nailer to swing away from the chamber and develop a large exit therefrom upon the application of force corresponding to the force of a driver acting on a damaged nail in the chamber.

27. The improved nailer claimed in claim 26 including means associated with the nail guide and release to permit the translation of such guide and release away from the chamber during the application of the force corresponding to the force of the driver acting on a damaged nail in the chamber.

* * * * *